US006361305B1

(12) United States Patent
Hinzpeter et al.

(10) Patent No.: US 6,361,305 B1
(45) Date of Patent: Mar. 26, 2002

(54) ROTARY TABLET PRESS

(75) Inventors: Jürgen Hinzpeter; Ulrich Zeuschner, both of Schwarzenbek; Hans-Joachim Pierags, Reinsbek; Nils Petersen, Hohnstorf; Peter Lüneburg, Berkenthin; Elke Wittenberg, Gülzow; Ulrich Arndt, Lauenburg; Hans Wolf, Schwarzenbek, all of (DE)

(73) Assignee: Wilhelm Fette GmbH, Schwarzenbek (DE)

( * ) Notice: Subject to any disclaimer, the term of this patent is extended or adjusted under 35 U.S.C. 154(b) by 0 days.

(21) Appl. No.: 09/551,792

(22) Filed: Apr. 18, 2000

(30) Foreign Application Priority Data

May 4, 1999 (DE) ..... 199 20 380

(51) Int. Cl.[7] ..... B30B 11/01

(52) U.S. Cl. ..... 425/193; 425/345; 425/182; 425/353

(58) Field of Search ..... 425/182, 193, 425/365, 353, 48

(56) References Cited

U.S. PATENT DOCUMENTS 3,825,387 A * 7/1974 Gilman ..... 425/182
4,362,491 A * 12/1982 Livingstone ..... 425/193
4,988,275 A * 1/1991 Hinzpeter et al. ..... 425/193
5,004,413 A * 4/1991 Stopforth ..... 425/345

FOREIGN PATENT DOCUMENTS

EP 0 288 798 A2 4/1988
EP 0 460 295 A1 12/1990

* cited by examiner

*Primary Examiner*—Nam Nguyen
*Assistant Examiner*—Thu Khanh Nguyen
(74) *Attorney, Agent, or Firm*—Faegre & Benson LLP

(57) ABSTRACT

A rotary tablet press, with a die plate rotatably mounted in a housing, which comprises guides for the upper and lower punch, whose position is controlled by cam disks rigid with the housing, and with an upright drive shaft which is arranged below the die plate and which can be releasably coupled to the die plate, wherein the die plate is formed such that after releasing from the drive shaft and a slight raising it may be moved out laterally, wherein at the ends, facing one another, of the die plate and drive shaft there is provided a quick locking whose parts are arranged in cavities of the die plate and drive shaft and which may be actuated by an actuation rod which is movably mounted in an axial channel of the drive shaft and is actuatable by an actuation device for the selective tensioning or releasing of the die plate and drive shaft.

14 Claims, 3 Drawing Sheets

ROTARY TABLET PRESS

The invention relates to a rotary tablet press with a die plate rotatably mounted in a housing.

Such tablet presses comprises a so-called die plate with die bores with which the upper and lower punch cooperate, these being guided in the die plate. The movement of the upper and lower punch are to some extent controlled by cams. Corresponding plates or rings are arranged rigid with the housing below or above the die plate whilst the die plate is rotatably mounted and is drivable by an upright shaft arranged there below. For reasons of cleaning or the exchange of the punch it is from time to time necessary the re-equip the machine. From EP 0 288 798 it is known to provide the cams with retainers which can be connected to stationary housing parts by way of releasable connecting means. Via lugs the cams are connected to the die plate such that after a releasing of the connecting means the die plate together with the upper and lower punch and the cams may be lifted off the drive shaft. With the help of a carrier aim or likewise which is laterally traversed in, the whole assembly may be moved laterally out of the machine.

With such rotary presses the actual actuation of the upper and lower punch is effected via so-called pressing rollers which where appropriate are mounted in a bearing which is rigid with the housing. For the removal of the described die plate assembly it is also necessary to either adjust or disassemble the pressing rollers so that the described removal of the die plate assembly may take place. From EP 0 460 295 it is also known to mount the pressing rollers in a bearing block which with a receiving flange is displaceably held in a guide of a housing by the drive for the pressing roller in the radial direction to the rotational axis of the die plate. The bearing block is releasably connected to the housing of the drive.

As mentioned, the die plate is set into rotation by a drive shaft which is rotatably mounted in the machine housing below the die plate and is driven by a suitable drive. The connection between the parts is effected preferably by way of a suitable screwing. Before the removal of the die plate this screwing is therefore to be released. Inversely the screwing after the renewed placing-on of the die plate must be actuated in order to connect the parts to one another. This procedure is relatively complex, not least because the access to the screw locations is difficult.

It is therefore the object of the invention to provide a rotary tablet press, with which the connection between the die plate and drive shaft may be quickly made and released.

This object is achieved by the features of the present invention.

With the tablet press according to the invention at the ends, facing one another, of the die plate and drive shaft there is provided a quick lock whose parts are arranged on cavities of the die plate and the drive shaft. The actuation of the quick lock is effected via an actuation rod which is movably mounted in an axial channel of the drive shaft and is actuatable by an actuation device for the selective tensioning and releasing of the lug plate and drive shaft.

The quick lock envisages movably mounted means which selectively may be brought into engagement with locking or tensioning surfaces of the lug plate in order to rotationally rigidly couple the lug plate to the drive shaft. For this reason the described means are arranged in the cavity of the drive shaft but however project from the cavity beyond the end of the drive shaft and engage into the facing cavity of the die plate, in order to selectively lock or release this. The actuation of these means is effected via an actuation rod in the hollow lug shaft wherein the actuation rod is however preferably mounted axially movable in order to actuate the quick lock. The actuation of the actuation rod must be effected from outside the drive shaft, wherein for this a separate drive is provided. Alternatively also an actuation by hand is conceivable.

Various designs for the quick lock and the type of rotational coupling are conceivable. According to the invention one envisages that the drive shaft and the die plate comprise annular lug surface which may bear against one another and which may be tensioned against one another with the help of the quick lock. It is conceivable the bring the lug surfaces into engagement with one another with a positive fit, i.e. to form these similar to a claw. They may however also be smooth when an adequate pressing force is produced for the friction transmission of the rotating force.

Furthermore in the cavity of the matrix disk and/or the drive shaft there may be provided a clamping surface, for example a conical angular surface which may be selectively brought into engagement with a clamping element actuated by the actuation rod. On actuation of the clamping element this engages the clamping surface and pulls the die plate disk and drive shaft against one another.

The actuation of the clamping element according to a further formation of the invention is effected preferably with the help of a tensioning cone which is connected to the axially movable actuation rod. The tensioning cone cooperates with one cone surface with an actuation surface of the tensioning element, so that this element for its part with the tensioning surface mainly cooperates with the die plate. Preferably there are provided a multitude of claw-like tensioning elements uniformly distributed in the circumferential direction, which are pivotable mounted about an axis approximately perpendicular to the axis of the drive shaft in the cavity of the drive shaft.

The tensioning cone may, according to a further formation of the invention, comprise a conical bracing surface at an axial distance to the tensioning cone surface, this bracing surface cooperating with a conical actuation surface on the tensioning element in a mauler such that the tensioning element is moved in the release position when the bracing surface is brought into engagement with the actuation surface. This formation is an alternative to a possible spring impingement of the tensioning element in a manner such that it is biased into the release position.

It is conceivable in the cavity of the die plate and the drive shaft by way of suitable shaping machining to manufacture tensioning surfaces. Preferably however a separate tensioning ring is provided which is mounted in the cavity, preferably in that it is screwed into the cavity, as a result has a thread on the outer side.

If several tensioning elements are provided, then these according to one formation of the invention may not only be pivotable but also radially movable in a limited maimer. If the tensioning elements are provided with oppositely aligned conical tensioning surfaces and the die plate and drive shaft in each case have one tensioning surface, wherein the angles of the tensioning surfaces are likewise oppositely aligned, it is then possible by radial adjustment of the tensioning element to create an axial force between the two parts to be tensioned. In order to effect a pivoting mounting of the tensioning elements, according to one formation of the invention these have radial outer lying bearing projections which cooperate with the bearing ring which cooperates with a shoulder of the cavity of the drive shaft. The bearing ring, which preferably is formed of plastic, may comprise bearing chambers limited by radial webs, in which the bearing projections of the tensioning elements are accommodated.

According to a further formation of the invention the drive shaft comprises a centering ring which surrounds the upper part of the drive shaft and projects upwardly beyond the lug surface. Its inner diameter is dimensioned in a manner such that an end section of an axial cylindrical collar of the die plate may fittingly engage into the centering ring.

Various possibilities are conceivable to adjust the actuation rod at a distance to the quick lock. According to the invention one envisages that the rod comprises an adjusting thread at a distance to the free upper end, in which a spindle nut is seated. The spindle nut in a suitable maimer is axially secured in the channel of the drive shaft. A rotational drive laterally of the drive shaft comprises an adjusting wheel which via an opening in the drive shaft cooperates with the spindle nut. The spindle nut may therefore on the outside comprise a toothing and the adjusting wheel a complementary toothing in order to effect a rotation of the nut. Since the spindle nut of the actuation rod is only effected temporarily during a change or removal or installation of the die plate, the rotational drive is adjustably mounted in order during the normal operation of the drive shaft to bring the adjusting wheel outside the operating region of the drive shaft.

The invention is hereinafter described in more detail by way of one embodiment example shown in the drawings.

Figure 1:
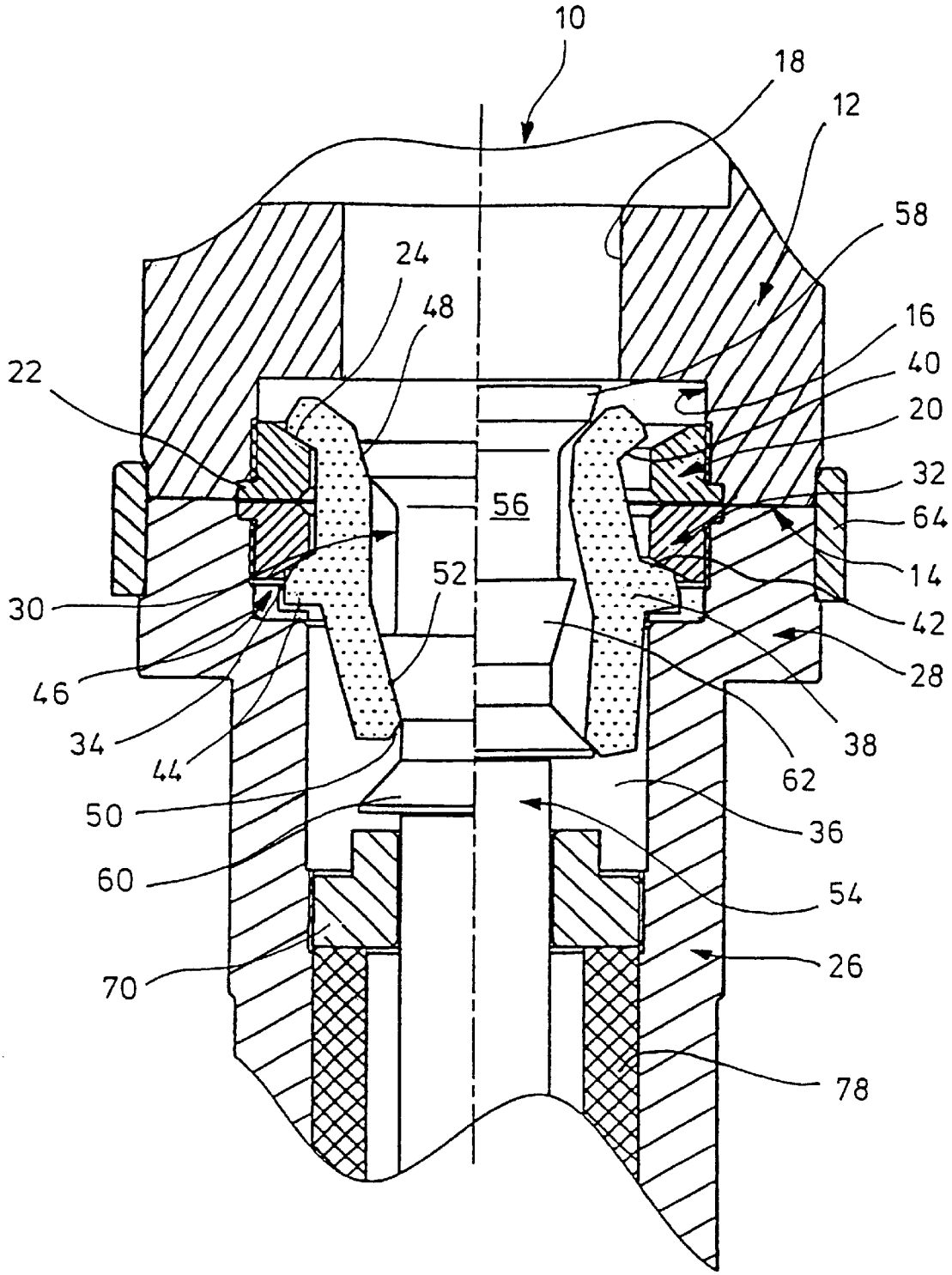
FIG. 1 shows a section through the die plate and the drive shaft in the connection region with a quick lock according to the invention.

Of a die plate 10 of a tablet rotary press, similar to that described in EP 0 288 798, in FIG. 1 only the ring-cylindrical collar 12 at the lower end of the die plate 10 is shown in section. The collar 12 has at the lower free end a cylindrical lug surface 14. In the collar 12 there is formed a cylindrical cavity 16 which is accessible from the annular surface 14. The cavity 16 blends into a bore 18 of a more narrow diameter, which is not gone into in any more detail.

The walling of the cavity 16 has a thread, and a ring 20 with an outer thread is screwed into the cavity 16, wherein a flange 22 of the ring 20 cooperates with a positive fit with a corresponding recess on the end-face surface of the die plate 10 and limits the screwing-in of the ring 20. The ring 20 has a conical tensioning surface 24 which faces the base of the cavity 16.

A drive shaft 26 for the die plate 10, which in a manner and way not shown is connected to a rotational drive for rotating the die plate 10, is provided at the upper end with a section 28 with a widened diameter. This section contains a cavity 30, which likewise is cylindrical and has approximately the same diameter as the cavity 16. Also the cavity 30 is provided with a thread into which a further tensioning ring 32 is screwed. The tensioning ring 32 comprises a tensioning surface 34 which is conical and which faces the base of the cavity 30. The tensioning surfaces 24, 34 are as a result oppositely aligned.

The cavity 30 blends into an axial channel 36 of the drive shaft 26.

In the cavities 16, 30 there are arranged tensioning elements 38. In total there are provided eight tensioning elements 36. As can be deduced from FIG. 3 the tensioning elements are formed segment-like in cross section and are arranged at uniform circumferential distances. Each tensioning element 38 comprises a first outwardly facing conical tensioning surface 40 as well as an outer conical tensioning surface 42 at an axial distance to the tensioning surface 40. The tensioning surfaces 40, 42 are designed such that in the position which is shown on the left side of FIG. 1 they cooperate with the tensioning surfaces 24, 34 of the tension rings 32, 20 and produce an axial force of the rings on one another. This is gone into in more detail further below.

The tensioning, surface 42 is formed in a bearing projection 44 which is pivotably mounted in a limited manner about an axis approximately perpendicular to the axis of the drive shaft 26. Furthermore the tensioning elements may be radially moved in a limited maimer. The bearing ring 46 which is preferably formed of plastic, is seated on the base of the cavity 30 which is simultaneously a shoulder at the transition to the axial channel 36 of the drive shaft 26.

On the inner side each tensioning element 38 comprises a first conical actuation surface 48 at approximately the height of the tensioning surface 20. It further comprises a second actuation surface 50 at the lower end which extends a certain path into the channel 36. Finally each tensioning element 38 comprises a third conical actuation surface 52 which lies between the actuation surfaces 48, 50 and below the tensioning surface 42.

Figure 3:
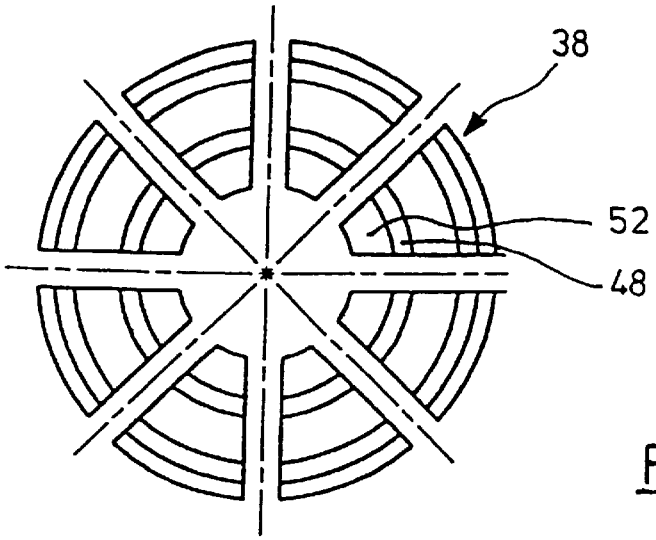
FIG. 3 shows a plan view of tensioning elements of the device according to FIG. 1.

The representation according to FIG. 3 shows the tensioning elements in the position as they assumed in the left side of FIG. 1.

Within the drive shaft 26, i.e. in the bore or in the channel 36 there is arranged an actuation rod 54. As is to be recognized by the two representations in FIG. 1, it is adjustable in the axial direction.

To the rod 36 there is connected a tensioning cone 56 which as also results from FIG. 1 is movable between two end positions. The tensioning cone 56 serves the actuation of the tensioning elements 38. The tensioning elements 38 have a tensioning position which is shown on the left side in FIG. 1 and a release position which is shown on the right side of FIG. 1. The tensioning position is therefore reached in one position of the tensioning cone 56 as is shown on the left side in FIG. 1. The release position corresponds to a position of the tensioning cone 56 as is represented on the right side in FIG. 1. The tensioning cone 56 has an upper and or first cone surface 58 which cooperates with the actuation surface 48. The tensioning cone 56 has a lower conical bracing surface 60 which cooperates with the actuation surface 50. Finally it has a third conical surface 62 between the described conical surfaces, which cooperates with the actuation surface 52.

If the actuation rod 36 is adjusted upwards into a position as is represented on the right side in FIG. 1, the cone surface 60 cooperates with the actuation surface 50 of the tensioning elements 38 so that these are pivoted into a position as is represented on the right side in FIG. 1. The bearing projection 44 of the tensioning elements thus rests against the associated inner edge of the bearing ring 46 and is tilted, wherein the tilting movement is limited by the abutment of the projection 44 against the tensioning surface 34 of the tensioning ring 32. As can be recognized, in this position of the tensioning elements 38 the collar 12 of the die plate 10 may be lifted upwards without further ado.

If on the other hand the tensioning cone 56 is moved downwards into a position as is shown in FIG. 1 on the left side, the conical surfaces 58 and 62 cooperate with the associated actuation surfaces 48, 52 of the tensioning elements 38. These are pivoted from the position shown in FIG. 1 on the right side into the position shown on the left side, by which means the tensioning surfaces 40, 42 cooperate with the associated tensioning surfaces 24, 35 of the tensioning rings 20, 32 and produce a considerable axial force, by which means the end surfaces of the die plate 10 and drive shaft 26 are tensioned against one another so that a rotational force may be transmitted. The axially acting force on the two parts to the first degree is caused by the fact that the tensioning elements 38 may also be radially pressed apart.

On the outer side of the extension of the drive shaft 26 there is attached a centering, ring 64 which projects a little beyond the end surface of the drive shaft 26. The collar 12 of the die plate 10, which has a section of a slightly reduced diameter at the free end, may be inserted fittingly into the centering ring 64. For this reason the pails to be coupled to one another have a central alignment to one another before they may be tensioned against one another with the described quick locking.

Figure 4:
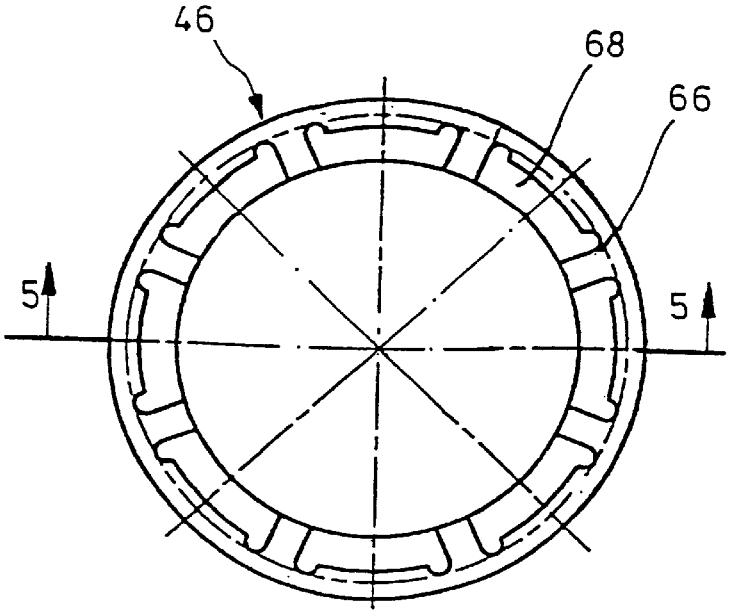
FIG. 4 shows a plan view of a bearing ring of the device according to FIG. 1.
Figure 5:
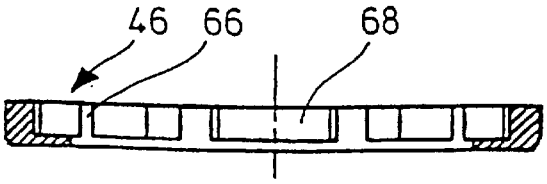
FIG. 5 shows a section through the representation according to FIG. 4 along the line 5—5.

As can be deduced from the FIGS. 1 and 5 the bearing ring 46 in cross section has an L-shaped contour. As can be deduced from FIG. 4 proceeding from the upright web there is formed a row of radial webs 66. Between the webs 66 there are formed receiving chambers for the bearing projections 44 of the tensioning elements 38.

Near to the tensioning cone 56 a bearing ring 70 is screwed into the bore 36. It serves for bearing and guiding the actuation rod 54.

Figure 2:
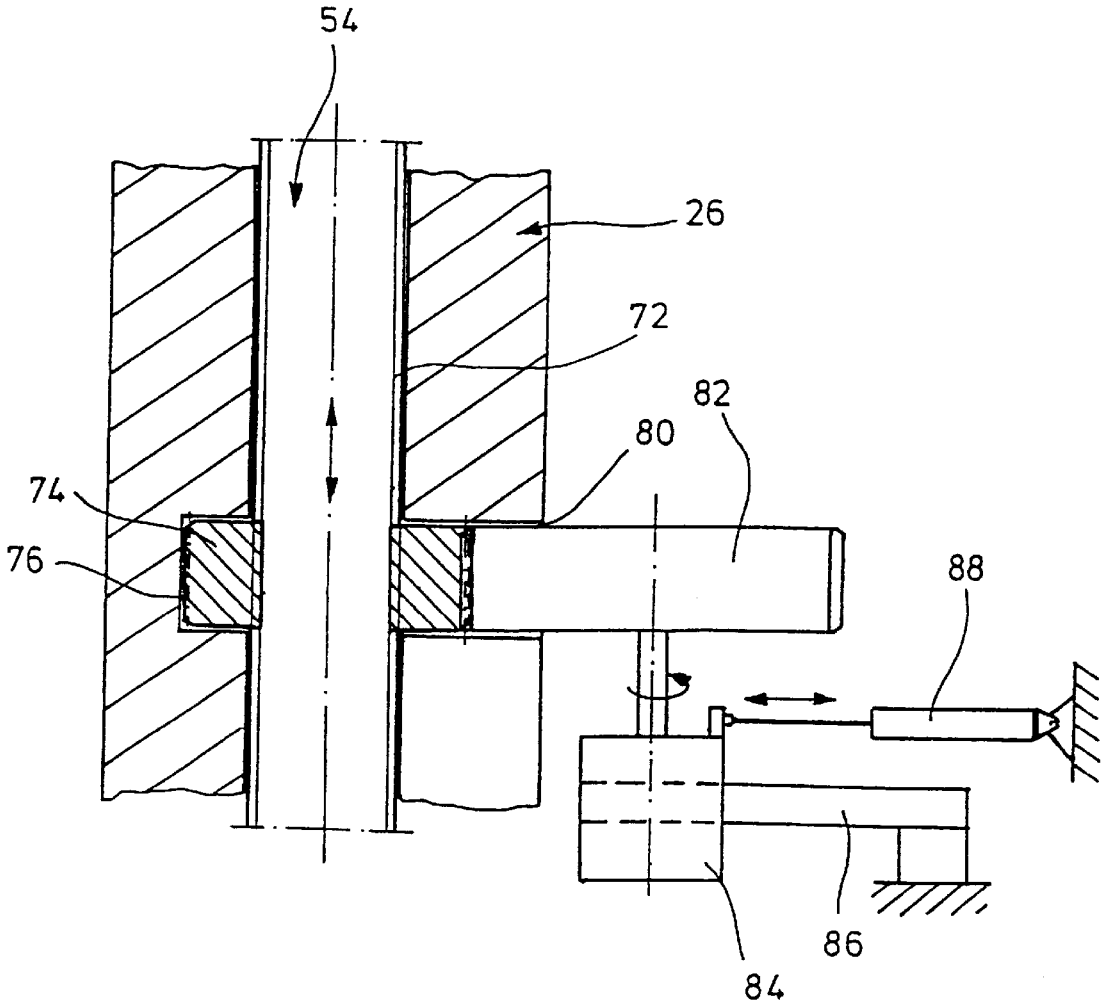
FIG. 2 shows a section through the lower region of a drive shaft with a drive for the actuation of the actuation rod.

In FIG. 2 extremely schematically there is shown the axial actuation of the actuation rod 54. At a distance to the bearing 70 the actuation rod 54 comprises a thread 72 on which there is seated a spindle nut 74. The spindle nut 74 is axially secured in a recess 76 of the shaft 26. It is also conceivable to provide a securement with a plastic bushing, as is arranged below the bearing ring 70 in FIG. 1 and here indicated at 78. In the region of the nut 74 the shaft 26 comprises a radial recess 80. Projecting into this is a gearwheel 82 which cooperates with an outer toothing of the spindle nut 74. The gearwheel 82 is driven by an electric motor 84 and with this rotates the spindle nut 74 by which means the rod is moved upwards or downwards according to the rotational direction. The motor 84 is movably mounted along a guide 86 which is rigid with the housing and may with the help of an adjusting cylinder 88 be moved along the guide 86, in order to bring the gearwheel 82 outside the drive shaft 26.

It is to be understood that the above mentioned procedures for coupling the die plate to the drive shaft may be effected automatically.

What is claimed is:

1. A rotary tablet press, with a die plate rotatably mounted in a housing, which comprises guides for an upper and a lower punch, whose position is controlled by cam disks rigid with the housing, and with an upright drive shaft which is arranged below the die plate and which can be releasably coupled to the die plate, wherein the die plate is formed such that after releasing from the drive shaft and a slight raising, said die plate is movable laterally, wherein at the ends of the die plate (10) and drive shaft (26) there is provided a quick lock having parts (38, 56) arranged in cavities of the die plate (10) and drive shaft (26) and which is actuatable by an actuation rod (54) which is movably mounted in an axial channel (36) of the drive shaft (26) and is actuatable by an actuation device (74, 82, 84) for the selective tensioning or releasing of the die plate (10) and drive shaft (26).

2. A rotary tablet press according to claim 1, characterized in that the drive shaft (26) and die plate (10) comprise annular lug surfaces (14) abutting against one another, the drive shaft (26) and/or die plate (10) radially within the lug surfaces (14) comprise annular conical tensioning surfaces (24, 34), in the cavity (30) of the drive shaft (26) and/or of the die plate (10) radially within the tensioning surfaces at least one moveable tensioning element (38), actuatable by the actuation rod, with a conical tensioning surface (40, 42) is movably mounted between a release position in which the die plate (10) may be placed freely on the drive shaft (26) or may be removed from this and a tensioning position, in which the conical tensioning surfaces of the die plate (10) and/or the drive shaft (26) on the one hand and the tensioning element (38) on the other hand may be tensioned against one another, and there is provided an actuation section (56) on the actuation rod (54) for the tensioning element (38).

3. A rotary tablet press according to claim 2 characterised in that a plurality of claw-like tensioning elements (38) uniformly distributed in the circumferential direction in the cavity (30) of the drive shaft (26) are pivotably mounted about an axis approximately perpendicular to the axis of the drive shaft (26).

4. A rotary tablet press according to claim 3 characterised in that each of the tensioning elements is mounted to be radially movable within limits and the die plate (10) and drive shaft (26) comprise respective oppositely directed tensioning surfaces (24, 34) which cooperate respectively with conical tensioning surfaces (40, 42) of each of the tensioning elements (38), the tensioning cone (56) comprises a third cone surface (62) located between the first cone surface (58) and the bracing surface (50) which cooperates with a further conical actuation surface (52) of the tensioning element (38) in a manner such that a radial pressure is produced on each of the tensioning elements (38) when the tensioning cone (56) brings the tensioning elements (38) into the tensioning position.

5. A rotary tablet press according to claim 3 characterised in that each of the tensioning elements (38) are provided with a bearing projection (44) between an upper and a lower end facing radially outwards which is mounted in a bearing ring (46) having an L-shaped cross section, and wherein the bearing ring (46) is arranged on a shoulder in the cavity (30) of the drive shaft (26).

6. A rotary tablet press according to claim 5, characterised in that the bearing ring (46) is formed of plastic.

7. A rotary tablet press according to claim 5 characterised in that the bearing ring (46) comprises bearing chambers (68), formed by radial webs (66), for the bearing projections (44) of the tensioning elements (38).

8. A rotary tablet press according to claim 1 characterised in that the actuation rod (54) is axially adjustable and is connected to a tensioning cone (56) which cooperates with a conical actuation surface (48, 52) of a tensioning element (38).

9. A rotary tablet press according to claim 8 characterised in that the tensioning cone (56) at an axial distance to the tensioning surface (40) comprises a conical bracing surface (60) which cooperates with a conical actuation surface (50) on the tensioning element (38) in a manner such that the tensioning element (38) is moved into the release position when the bracing surface (60) and actuation surface (50) are moved against one another.

10. A rotary tablet press according to claim 1 characterised in that a tensioning surface (24, 34) is formed on a tensioning ring (20, 32) which is screwed into one of the cavities (16 or 30) of the die plate (10) and the drive shaft (26).

11. A rotary tablet press according to claim 1 characterised in that the drive shaft (26) is surrounded by a centering ring (64) which projected beyond a lug surface at the top, and an axial collar (12) of the die plate (10) is fittingly accommodated in the centering ring (64).

12. A rotary tablet press according to claim 1 characterised in that the actuation rod (54) comprises an adjusting thread (72) on which a spindle nut axially secured in the channel (36) is arranged at a distance to an upper free end of the drive shaft (26), to provide a rotational drive (84) with a gear wheel (82) which can be brought into driving connection with a spindle nut (74) via an opening (80) in the drive shaft (26), wherein the rotational drive (84) is movably mounted, in order to selectively bring it out of engagement with the spindle nut (74).

13. A rotary tablet according to claim 12, further comprising a linear drive (88) engaging the rotational drive (84).

14. A rotary tablet press according to one of the claims 1 to 13, characterised in that an axial bearing (70) for the actuation rod (54) is arranged in the drive shaft (26) near to the quick lock.

* * * * *